US005695573A

United States Patent [19]

Becker

[11] Patent Number: 5,695,573

[45] Date of Patent: Dec. 9, 1997

[54] METHOD OF SANITARY CLEANING AND A SANITARY CLEANER

[76] Inventor: Klaus Becker, Gojenbergsweg 89 D-21029, Hamburg, Germany

[21] Appl. No.: 781,506

[22] Filed: Jan. 8, 1997

Related U.S. Application Data

[63] Continuation of Ser. No. 374,622, filed as PCT/EP94/01645, May 20, 1994 published as WO94/28100, Dec. 8, 1994, abandoned.

[30] Foreign Application Priority Data

May 21, 1993 [DE] Germany ..... 43 17 104.4

[51] Int. Cl.[6] ..... B08B 7/00; C23G 1/02

[52] U.S. Cl. ..... 134/3; 134/41; 134/6; 134/25.2; 134/25.3; 422/28; 422/37

[58] Field of Search ..... 134/3, 41, 25.2, 134/25.3, 6; 510/390, 382, 286, 319, 199, 501; 422/28, 37

[56] References Cited

U.S. PATENT DOCUMENTS

| | | | |
|---|---|---|---|
| 3,554,915 | 1/1971 | Keay et al. | 252/99 |
| 4,013,579 | 3/1977 | Nakasone et al. | 252/143 |
| 4,110,263 | 8/1978 | Lindemann et al. | 252/545 |
| 4,181,634 | 1/1980 | Kennedy et al. | 252/545 |
| 4,648,983 | 3/1987 | Broze et al. | 252/135 |
| 4,776,974 | 10/1988 | Stanton et al. | 252/106 |
| 5,336,500 | 8/1994 | Richter et al. | 424/405 |
| 5,437,868 | 8/1995 | Oakes et al. | 424/405 |

FOREIGN PATENT DOCUMENTS 1171943 11/1969 United Kingdom .

WO/91/05842 5/1991 WIPO .

*Primary Examiner*—Zeinab El-Arini

*Attorney, Agent, or Firm*—McAulay Fisher; Nissen Goldberg & Kiel, LLP

[57] ABSTRACT

A method for sanitary cleaning using a sanitary cleaner in liquid or solid form containing organic substances inhibiting microbial action in a quantity of at lest about 0.5 g/kg sanitary cleaner, usual lime-dissolving water-soluble acids, organic substances promoting microbial action, which are resistant against the lime-dissolving water-soluble acid, in a quantity of at least 10 mg/kg sanitary cleaner, and optionally further additives, in which after the dilution or flushing the germs degrading the organic substance of the water are promoted in their effectiveness. The sanitary cleaner contains as germ-promoting organic substance a compound of the general formula (I) $R_1R_2N—CO—NR_3R_4$ in which $R_1$ to $R_4$ are present independently from one another in open-chain form or cyclic and may have the following meaning: hydrogen, a low alkyl group having 1 to 4 carbon atoms, a cycloalkyl group having 3 to 6 carbon atoms, an aryl group in form of a phenyl or naphthyl residue, an aralkyl group having 7 to 18 carbon atoms, an alkylaryl group having 7 to 18 carbon atoms or a heterocyclic group having 2 to 5 carbon atoms and containing O, S or N. The method and the sanitary cleaner used therewith promote the respiratory activity of the microflora in the municipal sewage water. With this method there is also achieved a desirable inhibition of microbial action function in the first phase of action of a sanitary cleaner, such as e.g. in a toilet bowl.

16 Claims, No Drawings

METHOD OF SANITARY CLEANING AND A SANITARY CLEANER

This is a continuation of application Ser. No. 08/374,622, filed May 5, 1995, now abandoned, which in turn, is a national phase application under 35 U.S.C. 371 of PCT/EP94/01645, filed May 20, 1994.

BACKGROUND OF THE INVENTION

1. Field of the Invention

The invention relates to a method of sanitary cleaning by means of a sanitary cleaner in liquid or solid form containing organic substances inhibiting microbial action in a quantity of at least about 0.5 g/kg sanitary cleaner, the usual lime-dissolving water-soluble acids, organic substances promoting microbial action, which are resistant against the lime-dissolving water-soluble acid, in a quantity of at least 10 mg/kg of sanitary cleaner, and optionally further additives, wherein the germs degrading the organic substance of the water are promoted in their action after diluting or flushing, and to the sanitary cleaner for implementing said method.

2. Description of the Prior Art

Prior art as described above results from the International Patent Application PCT/EP 90/01718. It shows the advantage that, on the one hand, the desirable inhibition of microbial action develops in the first active phase of a sanitary cleaner, such as e.g. in a toilet bowl, and, on the other hand, the degradation efficiency of the microflora of the waste water (in the second active phase) is not disturbed. In this respect, said prior art is therefore superior to a sanitary cleaner according to DE-OS 25 32 432. Said sanitary cleaner is effective in the first phase of action only, e.g. in a toilet bowl. Its effectiveness does not extend to the second phase of action. It is available in tablet form and serves chiefly for removing calcareous residues, citric acid being used as lime solvent.

In the sanitary cleaner in accordance with the PCT/EP 90/01718 it was found that it is desirable to increase its effectiveness in the second phase of action. Prior art, neither according to U.S. Pat. No. 4,013,579 nor to DD 241 747, does not give any suggestions as to that desirable improvement. U.S. Pat. No. 4,013,579 describes acid cleaning agents which mandatorily contain furancarboxylic acids or their derivatives. They are intended to remove soilings sticking to objects. U.S. Pat. No. 4,013,579 does not attribute a double function to the furancarboxylic acids or their derivatives, which show a high toxicity, as achieved in the prior art method according to PCT/EP 90/01718 with simultaneous use of germa-inhibiting and germ-promoting substances as described at the beginning. The group of compounds of furancarboxylic acids or their derivatives, which are termed "FCA" in the U.S. Pat. No. 4,013,579 is to replace oxalic acid hitherto used in the corresponding prior art. As opposed thereto, the FCA are supposed to be handled easier and safer because they do not show a comparable high toxicity. At any rate, they are still very toxic all the same. The invention, as described in the following, aims in particular at not to be forced to use such toxic agents in the sanitary cleaner. Their incorporation means that, in the said second phase of action already mentioned, the inhibition of microbial action is not removed, but due to the toxicity of the FCA present, the growth of the microorganisms, desired there, is excluded or at least undesirably reduced. The DD 241 747 refers to an agent for cleaning and disinfecting toilet flushing water tanks and basins which is intended to prevent the formation of calcareous residues. There is no hint of improving the microbacterial degradation of organic substances in the waste water. Comparatively complex compounds such as fatty alcohols, ethylene propylene copolmers and alkylphenol polyglycolethane are used which additionally pollute the waste water.

It was an object of the invention to further improve the initially described prior art so that the desired inhibition of microbial action is maintained in the first phase of action, as e.g. in a toilet basin, and, on the other hand, the degradation action of the microflora of the waste water (in the second phase of action) is further improved.

SUMMARY OF THE INVENTION

The above object is accomplished according to the invention in that the sanitary cleaner contains, as germ-promoting organic substance, an open-chain or cyclic compound of the formula (I) $R_1R_2N—CO—NR_3R_4$, in which $R_1$ through $R_4$ are present each independently from one another in open-chain form or cyclic form and may have the following meanings: hydrogen, a low alkyl group having 1 to 4 carbon atoms, a cycloalkyl group having 3 to 6 carbon atoms, an aryl group in form of a phenyl or naphthyl residue, an aralkyl group having 7 to 18 carbon atoms, an alkylaryl group having 7 to 18 carbon atoms or a heterocyclic group having 2 to 5 carbon atoms and containing O, S or N.

DESCRIPTION OF THE PREFERRED EMBODIMENTS

Also the following urea derivatives are intended to be within the scope of the above formula (I):

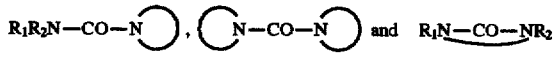

In Formula (I), the respective residues $R_1$, $R_2$, $R_3$ and $R_4$ are preferably hydrogen because the respective basic compounds are commercially available or easier to produce. Within the scope of the invention, the substituents as stated in the above definition of the invention are especially suitable. As low alkyl groups having 1 to 4 carbon atoms are herein considered the methyl- ethyl-, n-propyl-, i-propyl- and the various isomers of the butyl group. Among the cycloalkylic groups having 3 to 6 carbon atoms there are in particular the cyclopropyl-, cyclobutyl-, cyclopentyl- and the cyclohexyl residue, among the aralkyl group having 7 to 18 carbon atoms there are in particular the benzyl- and the phenethyl group, among the alkylaryl group having 7 to 18 carbon atoms there is in particular the tolyl group, and among the heterocyclic group having 2 to 5 carbon atoms, there are in particular such, in whose heterocyclic ring there is at least one oxygen, sulfur, or N-Atom. As suitable examples may be cited the radicals of the oxirane, tetrahydrofuran, dioxan and pyran. Principally, the compounds of formula (I) may be employed also in form of their salts or other precursors which may enhance solubility. In certain cases only this may lead to the desired solubility in the sanitary cleaner according to the invention. Therefore compounds may principally be used which set free compounds of formula (I) or allow to develop their effectiveness in the aqueous medium only. The following statements of quantities refer always to the compounds of formula (I) as such or to their portion within the suitable derivatives or compounds.

In addition to the mentioned compounds of the formula (I), other organic substances promoting microbial action may be added which are known from the international patent application PCT/EP 90/01718. Other known organic substances promoting and organic substances inhibiting microbial action have certain properties in common. So they are, as in particular also urea and urea derivatives, suitable within the scope of the invention, sufficiently resistant against organic acids or their salts within the usual temperature and pH-ranges.

As organic substances inhibiting microbial action may be considered in particular acid organic substances or their salts or suitable derivatives and ethereal oils. Natural organic substances which inhibit microbial action are preferred. Acid organic substances referred to are in particular aromatic, aliphatic, alicyclic and/or heterocyclic carboxylic acids or their salts, in particular in the form of alkali or alkaline-earth salts or also suitable derivatives thereof. Moreover, the acid organic substances for developing the desirable inhibition of microbial action should be sufficiently water-soluble. In certain cases, the carboxylic acid itself may be little water-soluble, however the appropriate salt thereof may be well water-soluble and suitable. Among the specially suitable aliphatic carboxylic acids are particularly the lower carboxylic acids having 1 to 7 carbon atoms, such as above all formic acid, acetic acid, propionic acid, caproic acid, malonic acid and oxalic acid as well as various fatty acids having 6 to 12 carbon atoms, such as sorbic acid or undecylenic acid, if they are usable in the form of suitable water-soluble salts. Fatty acids having more than 12 carbon atoms are not suitable as a rule because they themselves are not water-soluble, neither does the plurality of their salts meet the requirement of water-solubility. Butyric acid which is to be counted among the lower fatty acids is not recommendable on account of its unpleasant smell. Suitable derivatives of the above carboxylic acids are hydroxy acids such as glycolic acid, tartaric acid and citric acid as well as oxo acids such as acetoacetic acid and pyruvic acid. Particularly useful are also sufficiently water-soluble aromatic carboxylic acids such as benzoic acid, salicylic acid and also other phenolcarboxylic acids.

Of especial advantage are also ethereal oils. As microbicidal ethereal oils are to be considered: Oil of thyme, citrus oil, eucalyptus oils, clove oil, origanum oil, rosemary oil, cinnamon oil, elecampane oil, camphor oil, conifer oils and fennel oils. Oil of thyme is especially preferred. In their places may be used also the effective substances contained therein. Examples of substances inhibiting microbial action, which are contained in ethereal oils are: Thymol, carvacrol, terpineol, cineole and fenchone. The ethereal oils are water-insoluble, but they may be used in sanitary cleaners as germ-inhibiting substances together with appropriate, emulsifiers or solubilizers in particular those which are not harmful to the environment, just as the water-insoluble vitamins.

Virtually all surfactants ("tensides") may be used as solubilizers for the above group of substances. The selection of the most appropriate solubilizers for aqueous systems is carried out according to the HLB System and must be found individually for every ethereal oil by experiment. Solubilizers having HLB values in the range of 12 to 18 are especially suitable for ethereal oils. Especially such solubilizers are to be selected which are described in Römpps Chemie-Lexikon, 8th edition, vol. 3, page 2399. By principle, the following surfactants, derided into groups, are appropriate surfactants: anionic surfactants: fatty alkyl sulfonates such as Na-laurylethersulfate; cationic surfactants: quaternary ammonium compounds such as dodecyl dimethyl ammoniumchloride, betaine derivatives such as fatty-acid amidopropyl dimethyl amino acetic acid betaine; non-ionogenic emulsifiers or solution intermediaries: fruit acid esters of mono di glycerides such as citric acid esters, polyoxyethylene glycerol fatty-acid esters such as polyoxyethylene glycerol monolaurate having 30 mol of ethylene oxide.

Especially advantageous organic acids which inhibit microbial action were found to be formic acid, acetic acid, propionic acid, benzoic acid or simple derivatives of benzoic acid, sorbic acid, also in the form of suitable water-soluble salts thereof such as sodium and potassium salts. It is evident that the lime-dissolving organic acids such as citric acid, in general differ from the organic acids which inhibit microbial action, in terms of their effects in a suitable sanitary cleaner. In certain cases, an organic acid may be lime-dissolving on the one hand and moreover provide an inhibition of microbial action. In general, it is preferred to use such an acid which has a special lime-dissolving effect, and on the other hand such an organic compound which provides an especially high inhibition of microbial action.

The germ-inhibiting organic substances are contained in the sanitary cleaner according to the invention, irrespective of their being in powdered, granulated or liquid form, at least in a quantity of approximately 0.5 g/kg sanitary cleaner, and preferably in a quantity of about 0.5 to 150 g/kg sanitary cleaner, in particular in a quantity of 1 to 80 g/kg sanitary cleaner, and especially preferred in a quantity of about 2 to 7 g/kg sanitary cleaner.

The concentration of the germ-inhibiting organic substances in the first phase of action is preferably adjusted such that their concentration therein or in the basin to be cleaned amounts to at least approximately the minimum inhibiting concentration (MHK) and not over approximately 200 times the minimum inhibiting concentration (MHK). It is especially preferred that the concentration of the germ-inhibiting organic substances in the first phase of action amounts to at least about the double and not over about 50 times, in particular approximately 30 times, the minimum inhibiting concentration.

Within the scope of the invention there may be used as germ-promoting substances in addition to the mentioned compounds of formula (I), preferably also aminoacids and/or orotic acid or suitable salts or derivatives thereof as well as vitamins. The aforementioned derivatization must not go so far as to adversely affect the germ-promoting action desired. The preferred amino acids are alanine, arginine, asparagine, aspartic acid, citrulline, cysteine, cystine, glutamine, glutamic acid, glycine, histidine, hydroxyproline, iso-leucine, leucine, lysine, methionine, ornithine, phenylalanine, proline, serine, threonine, tryptophan, tyrosine and valin. Among the especially suitable vitamins including their provitamins count L-ascorbic acid, salts of ascorbic acid especially the Ca-salt, L-ascorbyl plamitate, (+)-biotin, b-carotene, cholecalciferol, cyanocobalamin, dihydrofolic acid, dehydroascorbic acid, ergocalciferol, folic acid, hydroxycobalamin, niacinamide, nicotinic acid (niacin), D-panthenol, D-pantothenic acid, pyridoxal, pyridoxal-5-phosphate, pyridoxamine, pyridoxamine-5'-phosphate, pyridoxine, pyridoxine phosphate, riboflavin, riboflavin-5'-phosphate, rutin, rutin salts, especially rutin sulfate, tetrahydrofolic acid, thiamin, thiamin nitrate, thiamine phosphoric esters, thiamine pyrophosphate, α-tocopherol, δ-tocopherol, α-tocopheryl acetate, α-tocopheryl quinone, α-tocopheryl phosphate, α-tocopheryl succinate, vitamin A acetate, vitamin A aldehyde, vitamin A alcohol, vitamin A acid, vitamin $B_4$ (adenine), vitamin $K_1$, vitamin $K_4$, vitamin P and vitamin U (methionine S-methylsulfonium chloride). In case that the vitamins have acid or basic groups it is generally possible to use also appropriate salts thereof.

The invention permits a hygienic cleaning of sanitary installations without disturbing the microbial degradation of the organic substances in the waste water. Such apparently contradictory properties could be accomplished by introducing the described germ-inhibiting or germicidal agents into the sanitary cleaner according to the invention in such a concentration, that their concentration during application in the therefor provided first phase of action, such as in toilet bowls, lies above the minimum inhibition concentration (MHK). This "minimum inhibition concentration" is a well known technical term. At the same time the germ-promoting organic substances are introduced into the product in a concentration, i.e. in an amount that after the usual dilution of the medium of the first phase, they subsequently exert a growth-promoting action upon the microorganisms on entering into the waste water.

On using the sanitary cleaner according to the invention, which may be present e.g. in powdered, granular or aqueous form, same may be diluted with little water e.g. in the toilet bowl. There the sanitary agents develop their germ-inhibiting or germicidal effects, whereas the germ-promoting substances initially remain inactive. After flushing the toilet bowl subsequent to the action of the sanitary cleaner, the concentration of the germ-inhibiting organic substances is reduced below the MHK value; thus they become ineffective. The gem-promoting organic substances are apportioned in their concentration in the sanitary cleaner according to the invention so that they even promote the activities of the waste water gems which degrade the organic substance after the flushing or a strong dilution; thus they accelerate the biological purification of the waste water or at least do not disturb it.

The quantity of gem-promoting substances in the form of compounds of the formula (I) in the sanitary cleaner according to the invention is not critical. In every individual case there must be tested which minimum concentration has to be used. As quantitative minimum is to be considered a quantity of approximately 10 mg/kg sanitary cleaner, in particular the range of about 10 mg/kg to about 50 g/kg sanitary cleaner, in particular approximately 1 g to 15 g/kg sanitary cleaner of the compounds (I) and/or (II).

As a quantitative guideline for the further germ-promoting organic substances which can be incorporated in addition to the already mentioned gem-promoting organic substances in the form of the compounds of formula (I) there may be mentioned a minimum quantity of 10 mg/kg, and in particular of about 10 to 1000 mg/kg. As further germ-promoting organic substances the mentioned substances may be considered, preferably aminoacid, vitamins, orotic acid and p-aminobenzoic acid. Of practical importance is a mixture of about 2 mg biotin, about 20 mg nicotinic amide, about 10 mg thiamin, about 10 mg p-aminobenzoic acid, about 5 mg pantothenic acid, about 50 mg pyridoxamin, about 2 mg cyanocobalamin (vitamin B12) and about 10 mg orotic acid, such mixture being present preferably in 1 kg of sanitary cleaner. For optimizing the effects of the gem-promoting organic substances desired, same are selected, if they are used as a mixture, qualitatively and quantitatively with respect to the respective environment.

Further known additives may be incorporated into the sanitary cleaner according to the invention, such as e.g. performes, coloring agents, biological foamers. The foamer used was found to be in particular a water-soluble protein substance with a concomitant germ-promoting action, such as water-soluble whey protein. The preferred concentration of a water-soluble protein substance is approximately 2 to 30 g, and most preferably approximately 5 to 10 g to approximately 1 kg powdery sanitary cleaner or approximately 1000 ml liquid sanitary cleaner. Naturally the invention does not preclude the addition of other substances known in prior art, which should be selected keeping in mind the maintenance of the advantages of environmental compatibility etc. as far as possible.

The particular advantage of the invention resides in the fact that the respiratory activity of the microflora in municipal waste waters may be enhanced to a surprising extent as shown by the following examples. Thus, the sanitary cleaner in accordance with the invention does lead to a sensible reduction of environmental pollution because its disinfecting effects derive from degradable natural substances, i.e. the lime-dissolving water-soluble acid, the germ-inhibiting organic substances and the germ-promoting organic substances in the form of the compounds according to formula (I), in particular in the form of urea, can be of natural origin. The sanitary cleaner in accordance with the invention is therefore especially propitious for the environment, meets the requirements placed and meets very much the desires of the consumers with increasing environmental conscience. It may therefore be used in many fields of applications, so in the whole field of sanitary cleaning such as in particular in toilet bowls, urinaries, bath tubs, bidets, wash basins and sbower tubs. This listing of application possibilities is not exhaustive.

In the following, the invention is further illustrated with reference to three formulation examples:

EXAMPLE 1

(Aqueous Product/Comparative Example in Accordance with PCT/EP 90/01718)

| | |
|---|---|
| Citric acid | 175 g |
| Sodium hydroxide | 22 g |
| Formic acid | 10 ml |
| Sodium benzoate | 2 g |
| Potassium sorbate | 2 g |
| Mixture of vitamins and amino acids (see below) | 0.5 g |
| Thickener (xanthan) | 5 g |
| soluble whey protein | 10 g |

The above mixture was filled up with water to make 1000 ml. The mixture of vitamins and amino acids was composed as follows: 2 mg biotin, 20 mg nicotinic amide, 10 mg thiamine, 10 mg p-aminobenzoic acid, 5 mg pantothenic acid, 50 mg pyridoxamine, 2 mg cyanocobalamin (vitamin B12) and 10 mg orotic acid.

EXAMPLE 2

(Invention)

| | |
|---|---|
| Citric acid | 175 g |
| Sodium hydroxide | 22 g |
| Formic acid | 10 ml |
| Sodium benzoate | 2 g |
| Potassium sorbate | 2 g |
| Urea | 1 g |
| Thickener (xanthan) | 5 g |
| soluble whey protein | 10 g |

This mixture was filled up with water to make 1000 ml.

EXAMPLES 3 AND 4

(Invention)

The formulation of example 2 was modified in that the quantity of urea was changed. It amounted to 2 g in example 3 and to 5 g in example 4.

Comparative Experiments

The positive effects of the sanitary cleaner of the above examples 1 through 4 upon the microflora of the waste water were to be examined. The respiratory activity of the microflora in municipal sewage water was measured in order to check if the mentioned sanitary cleaners were able to promote the flora and if they are easily degradable. Fresh sewage water was added to the products of the examples 1 through 4 above in three concentrations. After 24 hours the carbon dioxide formed was measured. The dry substance contents and the pH values of the products were measured in parallel.

Test Results pH Values and Dry Substances of the Products

| Product | pH value | dry substance (%) |
|---|---|---|
| 1 | 2.90 | 5.8 |
| 2 | 2.78 | 6.0 |
| 3 | 2.83 | 6.2 |
| 4 | 2.75 | 6.4 |

The products differ slightly as to their pH values and dry substances contents. Variations of the respiratory activity of the microflora are represented in the following Table 1.

TABLE 1

(Respiratory activity of the sewage flora as function of the composition of the sanitary cleaners and their concentration in sewage water)

| Product | Concentration of product in sewage water (%) | microbial respiratory activity (mg $CO_2$/ 10 ml sew. = 24 h) |
|---|---|---|
| Control (untreated waste water) | 0 | 3.18 |
| 1 | 0.1 | 4.06 |
| | 0.5 | 7.61 |
| | 1.0 | 8.31 |
| 2 | 0.1 | 4.09 |
| | 0.5 | 8.09 |
| | 1.0 | 9.23 |
| 3 | 0.1 | 5.16 |
| | 0.5 | 8.35 |
| | 1.0 | 10.36 |
| 4 | 0.1 | 5.85 |
| | 0.5 | 10.11 |
| | 1.0 | 10.73 |

The above comparative values show that the respiratory activity was noticeably enhanced due to the addition of urea as compared with the comparative product (1). The addition of 5 g of the growth factor in form of urea in sanitary cleaner No. 4 enhances the respiration as compared with the comparative product (1) up to an average of 135 (!) %. The addition of urea in the shown quantities results therefore in a remarkable enhancement of the effectivity of the waste water flora.

I claim:

1. In a cleansing method wherein a sanitizing cleanser is used to clean a surface, the cleanser being in liquid or solid form, and containing organic compounds which inhibit microbial action in a quantity of at least about 0.5 g/kg of sanitary cleanser, water soluble acids which dissolve lime, and organic compounds which promote microbial action and which are resistant against the water-soluble acid in a concentration of at least 10 mg/kg sanitary cleaner, the improvement which comprises said organic compound which promotes microbial action being an open-chain or cyclic compound having the formula:

$$R_1R_2N—CO—NR_3R_4, \quad (I)$$

in which $R_1$, $R_2$, $R_3$, and $R_4$ are the same or different and each may be linear, branched, or cyclic and selected from the group consisting of hydrogen, lower alkyl having 1 to 4 carbon atoms, cycloalkyl having 3 to 6 carbon atoms, aryl in the form of a phenyl or naphthyl, aralkyl having 7 to 18 carbon atoms, alkylaryl having 7 to 18 carbon atoms or a heterocyclic group having 2 to 5 carbon atoms and containing O, S or N, or wherein $R_1$ and $R_2$ may together form a cyclic ring and $R_3$ and $R_4$ may together form a cyclic ring.

2. The method of claim 1 wherein $R_1$, $R_2$, $R_3$, and $R_4$ are each hydrogen.

3. The method of claim 2 wherein the concentration of the organic compounds which promote microbial action is from about 10 mg/kg to 50 g/kg of cleanser.

4. The method of claim 3 wherein the concentration of the organic compounds which promote microbial action is from about 1 g/kg to 15 g/kg of cleanser.

5. The method of claim 2 wherein the cleanser contains additional substances which promote microbial action selected from the group consisting of amino acids, orotic acid, salts of amino acids, salts of orotic acid, and vitamins in a microbial action promoting effective amount.

6. The method of claim 2 wherein the organic compounds which inhibit microbial action are present in an amount of from about 1 to 150 g/kg of cleanser.

7. The method of claim 6 wherein the organic compounds which promote microbial action are present in an amount from about 100 to 1000 mg/kg of cleanser.

8. The method of claim 1 wherein the concentration of the organic compounds which promote microbial action is from about 10 mg/kg to 50 g/kg of cleanser.

9. The method of claim 8 wherein the concentration of the organic compounds which promote microbial action is from about 1 g/kg to 15 g/kg of cleanser.

10. The method of claim 1 wherein the cleanser contains additional substances which promote microbial action selected from the group consisting of amino acids, orotic acid, salts of amino acids, salts of orotic acid, and vitamins in a microbial action promoting effective amount.

11. The method of claim 1 wherein the organic compounds which inhibit microbial action are present in an amount of from about 1 to 150 g/kg of cleanser.

12. The method of claim 11 wherein the organic compounds which promote microbial action are present in an amount from about 100 to 1000 mg/kg of cleanser.

13. In a sanitizing cleanser which contains organic compounds which inhibit microbial action in a quantity of at least about 0.5 g/kg sanitary cleaner, water soluble acids which dissolve lime, and organic compounds which promote microbial action and which are resistant against the water-soluble acid in a concentration of at least 10 mg/kg sanitary cleaner, the improvement which comprises said organic compound which promotes microbial action being an open-chain or cyclic compound having the formula:

$$R_1R_2N—CO—NR_3R_4, \quad (I)$$

in which $R_1$, $R_2$, $R_3$, and $R_4$ are the same or different and each may be linear, branched, or cyclic and selected from the group consisting of hydrogen, lower alkyl having 1 to 4 carbon atoms, cycloalkyl having 3 to 6 carbon atoms, aryl in the form of a phenyl or naphthyl, aralkyl having 7 to 18 carbon atoms, alkylaryl having 7 to 18 carbon atoms or a heterocyclic group having 2 to 5 carbon atoms and containing O, S or N, or wherein $R_1$ and $R_2$ may together form a cyclic ring and $R_3$ and $R_4$ may together form a cyclic ring.

14. The cleanser of claim 13 wherein the organic compounds which inhibit microbial action are present in an amount of from about 1 to 150 g/kg of cleanser and the substance which promote microbial action are present in an amount up to 50 g/kg of cleanser.

15. The cleanser of claim 13 which further contains about 2 to 30 g/kg of cleanser of a water-soluble protein.

16. The cleanser of claim 15 wherein the water-soluble protein is water-soluble whey protein.

* * * * *